US008726553B2

(12) United States Patent
O'Brien

(10) Patent No.: US 8,726,553 B2
(45) Date of Patent: May 20, 2014

(54) SIMULATED-WOVEN LABEL FOR USE WITH A WOVEN LABEL ON A GARMENT

(75) Inventor: Kevin J. O'Brien, Lewis Center, OH (US)

(73) Assignee: Artco Global Group, Mechanicsburg, PA (US), part interest ( * ) Notice: Subject to any disclaimer, the term of this patent is extended or adjusted under 35 U.S.C. 154(b) by 0 days.

(21) Appl. No.: 12/014,855

(22) Filed: Jan. 16, 2008

(65) Prior Publication Data

US 2009/0178311 A1 Jul. 16, 2009

(51) Int. Cl.
*G09G 3/00* (2006.01)

(52) U.S. Cl.
USPC ..... 40/661.04; 40/299.01

(58) Field of Classification Search
USPC ..... 40/299.01, 329, 661.04
See application file for complete search history.

(56) References Cited

U.S. PATENT DOCUMENTS

| | | | | |
|---|---|---|---|---|
| 5,423,139 | A * | 6/1995 | Feldman | 40/673 |
| 5,885,398 | A | 3/1999 | Poirier | |
| 6,210,778 | B1 | 4/2001 | Poirier | |
| 6,440,254 | B1 | 8/2002 | Rich | |
| 6,737,114 | B2 | 5/2004 | Dawson | |
| 6,752,075 | B2 * | 6/2004 | Ciaramitaro et al. | 101/33 |
| 6,779,731 | B2 | 8/2004 | Duldhardt | |
| 7,063,028 | B2 * | 6/2006 | Codos et al. | 112/2.1 |
| 7,087,276 | B2 | 8/2006 | Sasaki | |
| 2005/0102876 | A1 | 5/2005 | Kelly | |
| 2006/0021270 | A1 | 2/2006 | Hanley | |
| 2008/0263919 | A1 * | 10/2008 | Halliday | 40/299.01 |
| 2009/0025123 | A1 * | 1/2009 | Weedlun et al. | 2/244 |

FOREIGN PATENT DOCUMENTS

FR 2870683 A1 * 12/2005

OTHER PUBLICATIONS http://krconnect.blogspot.com/2008_05_01archive.html.*
http://www.glamoursurf.com/swinwear_label_reference.html Dec. 13, 2008.*

* cited by examiner

*Primary Examiner* — Casandra Davis
(74) *Attorney, Agent, or Firm* — Porter, Wright, Morris & Arthur LLP

(57) ABSTRACT

Labels for a garment include a fabric first label with brand indicia woven therein for attachment to the garment and a fabric second label with content indicia printed thereon for attachment to the garment. The printed content indicia has an appearance of being woven like the woven brand indicia. The content indicia is preferably printed in a font having an appearance similar to alphanumeric characters of the woven brand indicia. The font preferably resembles a thread pattern of the alphanumeric characters of the woven brand indicia.

2 Claims, 2 Drawing Sheets

SIMULATED-WOVEN LABEL FOR USE WITH A WOVEN LABEL ON A GARMENT

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The field of the present invention generally relates to labels and, more particularly, to labels for use on a garment.

BACKGROUND OF THE INVENTION

A garment, whether it be a pair of jeans or a polo shirt, typically has at least one label attached thereto. A main or brand label is typically provided on the garment which includes information regarding the brand name or trademark of the designer, retailer, manufacturer, and/or the like. The main label can also include information regarding garment size, garment care instructions, garment content, and/or any other desired information. The garment content information typically includes the percentage of materials used in the garment and the country of origin (COO) of the materials used in the garment. A separate size/content/care instructions (S/C/C) label is often provided on the garment which includes the information regarding garment size, garment care instructions, and/or garment content. In some instances three or more labels are utilized in order to provide all of the desired information to the consumer.

Currently, the information on these labels is printed with ink due to the superior speed and cost of printed labels as compared to woven labels where the information is provided with woven thread. Woven labels can take up to three weeks to obtain as compared to as little as one week for printed labels. Additionally, the printed labels can usually be obtained at a cost less than the woven labels. However, almost all high end retailers prefer the texture and appearance of woven labels as compared to printed labels. Many retailers believe consumers associate woven labels with higher quality garments. Thus, it is desirable to have woven labels, particularly when the labels are conspicuously and immediately viewable by the consumer at the point of sale.

Retailers often obtain very large quantities of individual types of garments over a considerable period of time. Due a wide variety of reasons, garment production may be switched from one manufacturer to another manufacturer (sometimes located in a different country) with little advanced warning. While this is not a problem with some labels, it may require frequent changes to the labels which include the content information (typically the S/C/C label). As a result, the S/C/C/ labels are seldom if ever stocked because they continuously change. Retailers are often faced with the dilemma of either waiting a lengthy period of time for new woven labels (with a possible loss of sales due lack of supply on store shelves) or more quickly obtaining printed labels (with a possible appearance of a lack of quality).

There is a desire to reduce the cost and/or lead time for garment labels while retaining the desirable texture and appearance of woven labels. Accordingly, there is a need in the art for improved garment labels.

SUMMARY OF THE INVENTION

The present invention provides improved garment labels which overcome at least some of the above-noted problems of the related art. According to the present invention, a combination of labels for a garment comprises a first label with first indicia woven therein for attachment to the garment and a second label with second indicia printed thereon for attachment to the garment. The printed second indicia has an appearance of being woven like the woven first indicia.

According to another aspect of the invention, a garment comprises a garment body, a first label with first indicia woven therein and secured to the garment body, and a second label with second indicia printed thereon and secured to the garment body. The printed second indicia has an appearance of being woven like the woven first indicia.

According to another aspect of the invention, a combination of labels for a garment comprises a fabric first label with brand indicia woven therein for attachment to the garment and a fabric second label with content indicia printed thereon for attachment to the garment. The printed content indicia has an appearance of being woven like the woven brand indicia. The content indicia is printed in a font having an appearance similar to alphanumeric characters of the woven brand indicia. The font resembles a thread pattern of the alphanumeric characters of the woven brand indicia.

From the foregoing disclosure and the following more detailed description of various preferred embodiments, it will be apparent to those skilled in the art that the present invention provides a significant advance in improved garment labels. Particularly significant in this regard is the potential the invention affords for labels with relatively low cost and/or low lead time while retaining the desirable texture and appearance of woven labels. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
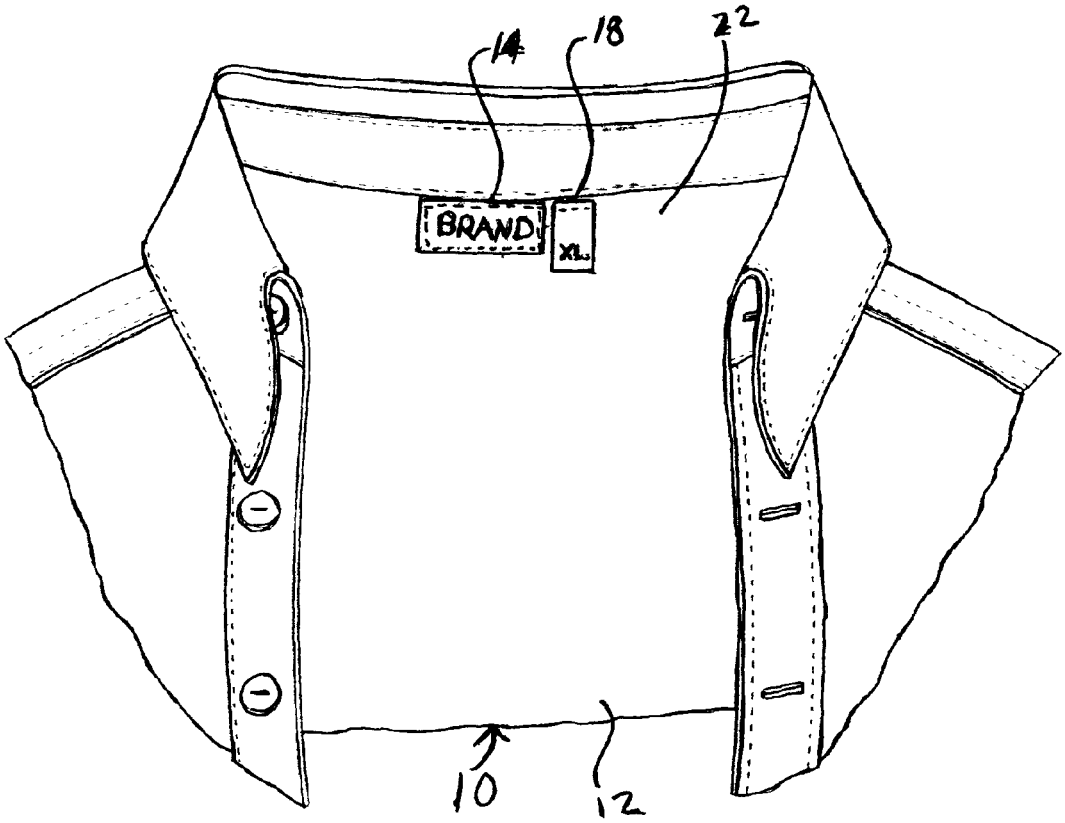
FIG. 1 is a partial front view of a garment having a woven brand label and a printed S/C/C label according to the present invention.

It should be understood that the appended drawings are not necessarily to scale, presenting a somewhat simplified representation of various preferred features illustrative of the basic principles of the invention. The specific design features of the labels as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the labels illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved labels disclosed herein. The following detailed discussion of various alternative and preferred embodiments will illustrate the general principles of the invention with reference to a shirt having a main label and a S/C/C label, located at the neck. Other embodiments suitable for other applications of the invention will be apparent to those skilled in the art given the benefit of this disclosure such as, for example, the garment could be of a different type and/or one or more of the labels can be at a different location.

Referring now to the drawings, FIG. 1 illustrates a garment 10 according to the present invention. The illustrated garment 10 is in the form of a shirt but it is noted that the garment 10 can alternatively be of any other suitable type of garment known to those in the art. The illustrated garment 10 includes a garment body 12, a first or brand label 14 with first indicia or information 16 woven therein and secured to the garment body 12 and a second or size/content/care instructions (S/C/C) label 18 with second indicia or information 20 printed thereon and secured to the garment body 12. It is noted that the garment 10 can include additional labels within the scope of the present invention. The illustrated garment body 12 comprises fabric but it is noted that the garment body 12 can alternatively comprise any other suitable material known to those in the art.

The brand label 14 and the S/C/C label 18 are each preferably located in a conspicuous area of the garment 10 that is immediately visible to a consumer at a point of sale. The illustrated brand and S/C/C labels 14, 18 are centrally located at the back of the neck or collar 22 of the garment 10. It is noted that the brand and S/C/C labels 14, 18 can alternatively be located at any other suitable location. The illustrated brand and S/C/C labels 14, 18 are located in close proximity to each other in a side-by-side configuration so that they are seen by the consumer at the same time. It is noted that the proximity of the labels 14, 18 enhances the effectiveness of the present invention which creates the appearance that the S/C/C label 18 is woven similar to the brand label 14 as described in more detail hereinafter. The S/C/C label 18 is preferably located immediately adjacent the brand label 14 (that is, such that they can be viewed by the consumer at the same time), more preferably located within 5 inches of the brand label 14, and most preferably located within 1 inch of the brand label 14. While the illustrated brand and S/C/C/ labels 14, 18 are located side-by-side, it is noted that the labels 14,18 can be in other configurations such as, for example, the S/C/C label 18 can be under the brand label 14 so that it extends beneath the bottom of the brand label 14 (that is, overlapped by the brand label 14), the S/C/C label 18 can be hanging from the bottom of the brand label 14, or the S/C/C label 18 can be at any other suitable location.

The brand label 14 and the S/C/C label 18 can be secured to the garment body 12 in any suitable manner such as sewing, stapling, or the like. The illustrated brand label 14 is sewn to the garment body 12 on all four sides. The illustrated S/C/C label 18 is sewn to the garment body only at the top so that the S/C/C label 18 can be folded up by the consumer to read information printed on the underside. It is noted that while the illustrated labels 14, 18 are secured to the garment 10 separately, they can alternatively be secured to one another and then secured to the garment 10.

Figure 2:
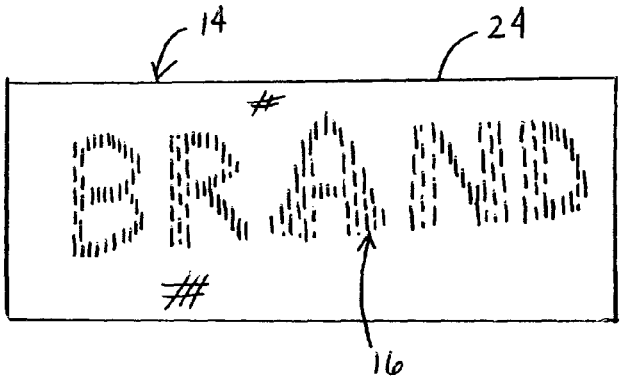
FIG. 2 is an enlarged, front elevational view of the woven brand label of the garment of FIG. 1.
Figure 4:
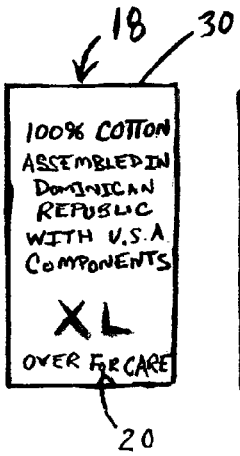
FIG. 4 is an enlarged, front elevational view of the printed S/C/C label of the garment of FIG. 1.
Figure 5:
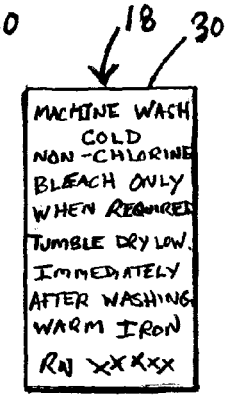
FIG. 5 is a rear elevational view of the printed S/C/C label of FIG. 4.
Figure 3:
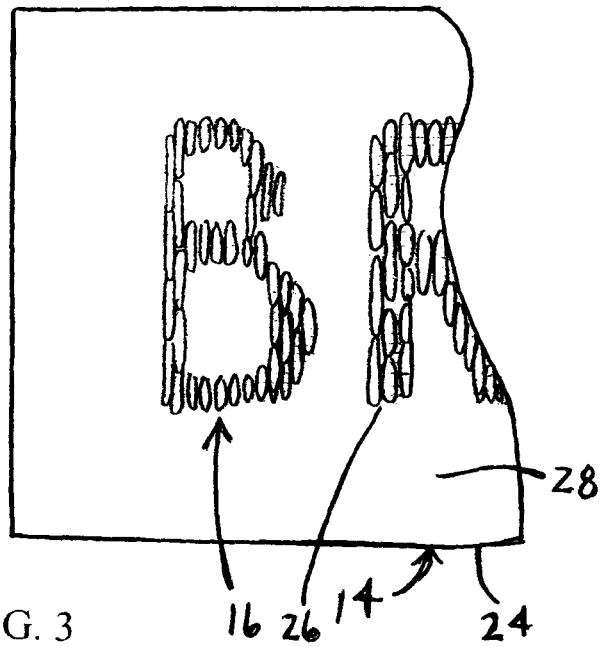
FIG. 3 is an enlarged, partial front elevational view of the woven brand label of FIG. 2.
Figure 6:
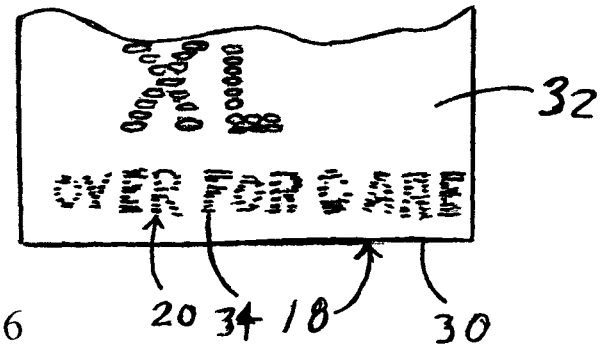
FIG. 6 is an enlarged, partial front elevational view of the printed S/C/C label of FIGS. 4 and 5.
Figure 7:
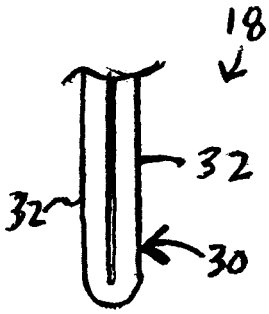
FIG. 7 is a side elevational view of the printed S/C/C label of FIG. 6.

As best shown in FIGS. 2 and 3, the illustrated brand label 14 includes a rectangular shaped body 24 and the first indicia 16 woven into the body 24. It is noted that the body 24 can alternatively have any other suitable shape. The body 24 preferably comprises a fabric. The illustrated first indicia 16 is formed by threads woven into the fabric body 24. The illustrated first indicia 16 is formed with a thread pattern having a plurality of vertically-extending, parallel threads 26. It is noted that the woven threads run in an edge to edge direction for the small dimension of the label. It is also noted that any other suitable thread pattern can be utilized. The threads 26 forming the first indicia 16 preferably have a color that contrasts with threads forming the fabric body 24 so that the first indicia 16 can be easily seen by the consumer The brand label 14 is preferably relatively large in size so that consumers can immediately recognize the garment's brand. The illustrated brand label 14 is larger than the S/C/C label 18 but any other suitable size can alternatively be utilized.

The illustrated first indicia 16 is brand indicia which includes alphanumeric characters forming branding means such as, for example, a trademark, trade name, company name, logo, symbol, or the like to be associated with the garment 10. The alphanumeric characters can comprise any suitable font. It is noted that the first indicia 16 can alternatively or additionally include any other suitable information.

As best shown in FIGS. 4 to 7, the illustrated S/C/C label 18 includes a rectangular shaped body 30 and the second indicia 20 printed onto the body 30. The illustrated S/C/C label 18 is formed by folding or looping the elongate body 30 at the lower end of the label 18. While the illustrated S/C/C label 18 has a folded loop configuration, the S/C/C label 18 can alternatively have other configurations such as, for example, a single ply printed on one or both sides. The illustrated care label 18 is oriented with its longest side extending in the vertical direction compared to the illustrated brand label 14 which is oriented with its longest side extending in the lateral direction. It is noted that the body 30 can alternatively have any other suitable construction, shape, or orientation. The body 30 preferably comprises a fabric. Preferably, the S/C/C label 18 and the brand label 14 comprise a substantially similar color of fabric but any suitable color can alternatively be utilized. The illustrated second indicia 20 is formed by ink printed onto an outer surface 32 of the fabric body 30. The second indicia 20 can be printed by any suitable type printing means and any suitable type of ink which will withstand repeated washings (typically at least 25 washings). The ink forming the care indicia 20 preferably has a color that contrasts with threads forming the fabric body 30 so that the care indicia 20 can be easily seen by the consumer. The ink forming the second indicia 20 also preferably comprises a color substantially similar to the color of the treads 26 forming the first indicia 16.

The illustrated second indicia 20 includes garment size information, garment content information, garment care instruction information, and an RN number. It is noted, however, that the second indicia 20 can alternatively include less than all of the illustrated information, and/or any other desired additional information. The illustrated garment content information includes the percentage of materials used in the garment, the country of origin (COO) of the materials or components used in the garment, and the country of origin (COO) of assembly of the components (if different than the country of origin of the components). It is noted, however, that the content information can alternatively include less than all of the illustrated information, and/or any other desired additional information. The illustrated care instruction information includes washing and drying instructions. It is noted, however, that the care instruction information can alternatively include less than all of the illustrated information, and/or any other desired additional information. The alphanumeric characters of the second indicia 20 can comprise any suitable font. Preferably the font of the care indicia 20 is substantially similar to the font of the first indicia 16.

The illustrated printed second indicia 20 is adapted to have an appearance of being woven like the first indicia 16. The illustrated printed second indicia 20 is formed with a line pattern having a plurality of horizontally-extending, parallel dashed lines 34 that simulates a thread pattern of woven indicia which creates the appearance to the consumer that the printed second indicia 20 is woven rather than printed. The line pattern of the second indicia 20 is preferably substantially similar to the thread pattern of the first indicia 16. It is noted that threads of woven indicia typically run in an edge to edge direction for the small dimension of the label (like the thread pattern of the first indicia 16), so the illustrated line pattern of the second indicia 20 runs horizontally from edge to edge which is the small dimension of the S/C/C label 18. It is also noted that any other suitable line pattern can be utilized which provides the appearance of being woven.

Figure 8:
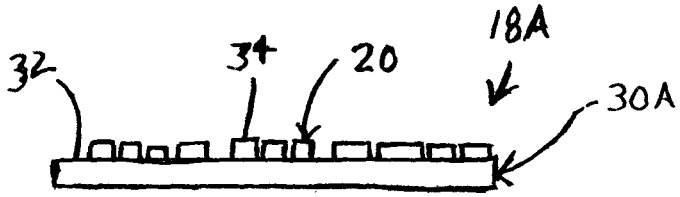
FIG. 8 is a bottom plan view of an alternative printed S/C/C label.

FIG. 8 illustrates an S/C/C label 18A according to an alternative embodiment of the present invention. The S/C/C label 18A of the second illustrated embodiment of the invention is substantially the same as the S/C/C label 18 of the first illustrated embodiment of the present invention except that a raised or elevated ink is utilized and the second label body 30A is of single ply construction and printed on only one side. The illustrated printed first indicia 20 is printed with raised or elevated ink so that the printed first indicia 20 is raised above the surface 32 of the second label body 30A. The raised ink provides a three dimensional look which simulates the appearance of a raised weave pattern. Thus, when the woven first indicia is formed with a raised weave pattern, the elevated ink provides a three-dimensional look or feel which creates the appearance to the consumer that the printed care indicia 20 is woven like the brand label 14 rather than printed. The second indicia 20 can be printed by puff printing, high density printing, 3D printing, or the like in order to create the appearance of a raised weave pattern. It is noted that when the woven first indicia 16 is formed by a relatively flat weave pattern such as, for example, a damask weave, it is preferred that the second indicia 20 be printed by flat or ordinary ink so that it more closely resembles the woven first indicia 16. The second label body 30A illustrates that the S/C/C label 18 can have alternative constructions (folded loop, single ply, or the like). The second label body 30A also illustrates that the second indicia can be printed on one or both sides of the S/C/C label 18. It is noted that when it is desired to print on both sides of the S/C/C label 18, it is preferred to have a folded loop configuration because woven S/C/C labels are typically of folded-loop construction when they have indicia 16 on both sides.

It is noted that each of the various features of the illustrated embodiments can be utilized with each of the other embodiments. For example, the folded loop-body 30 of the first illustrated embodiment can alternatively be printed on only one side and/or printed with elevated ink like the body 30A of second illustrated embodiment and the single-ply body 30A of the second illustrated embodiment can alternatively be printed on both sides and/or printed with flat ink like the body 30 of the first illustrated embodiment.

From the foregoing disclosure and detailed description of certain preferred embodiments, it is apparent that the present invention provides a printed label with the appearance of a woven label which coordinates with a woven label to maximize consumer impression while reducing production costs and delays.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A combination of labels for a garment comprising:

a woven label with first indicia woven therein for attachment to the garment;

a simulated-woven label with second indicia printed thereon for attachment to the garment;

wherein the woven first indicia includes brand indicia;

wherein the printed second indicia includes alphanumeric characters identifying at least one of materials used in the garment, country of origin of components used in the garment, and country of origin of assembly of the garment;

wherein the printed second indicia has an appearance which simulates being woven like the woven first indicia; and wherein the second indicia is printed with an elevated ink to resemble elevated threads of the woven first indicia.

2. A garment comprising:

a garment body; a woven label with first indicia woven therein and secured to the garment body;

a simulated-woven label with second indicia printed thereon and secured to the garment body;

wherein the woven first indicia includes brand indicia;

wherein the printed second indicia includes alphanumeric characters identifying at least one of materials used in the garment, country of origin of components used in the garment, and country of origin of assembly of the garment; and wherein the printed second indicia has an appearance which simulates being woven like the woven first indicia; and wherein the printed second indicia is printed with an elevated ink to resemble elevated threads of the woven first indicia.

* * * * *